United States Patent [19]

Reinecke et al.

[11] 4,100,868

[45] Jul. 18, 1978

[54] APPARATUS FOR LIMITING MAXIMUM NUMBER OF STITCHES OF SEWING-MACHINES

[75] Inventors: Harry Reinecke, Walldorf; Gerhard Bachmann, Eppelheim, both of Germany

[73] Assignee: Frankl & Kirchner GmbH. & Co. KG. Fabrik für Elektromotoren und elektrische Apparate, Schwetzingen, Germany

[21] Appl. No.: 749,094

[22] Filed: Dec. 9, 1976

[30] Foreign Application Priority Data

Dec. 10, 1975 [DE] Fed. Rep. of Germany ... 7539310[U]

[51] Int. Cl.[2] ..... D05B 69/18

[52] U.S. Cl. ..... 112/277

[58] Field of Search ..... 112/220, 221, 277, 275; 318/305

[56] References Cited

U.S. PATENT DOCUMENTS

| | | | |
|---|---|---|---|
| 2,262,616 | 11/1941 | List | 318/305 X |
| 3,217,679 | 11/1965 | Novak | 112/277 |
| 3,319,591 | 5/1967 | Hamlett | 112/220 |

*Primary Examiner*—Werner H. Schroeder
*Assistant Examiner*—Peter Nerbun
*Attorney, Agent, or Firm*—Browdy and Neimark

[57] ABSTRACT

A motor, a clutch and a brake part are provided to drive a sewing machine. Two potentiometers are connected in series with individual ones of two respective switches and in parallel across two leads of a control cable which is connected to a control box. The control box supplies power to the motor under the control of a pedal. One of the switches is a contact switch controlled by a knee switch one of whose surfaces, swivelable about an axis, rests against the actuating member of the contact switch. The other switch is a position switch, such as a toggle switch, and is carried by another surface of the knee switch.

8 Claims, 4 Drawing Figures

Fig. 1
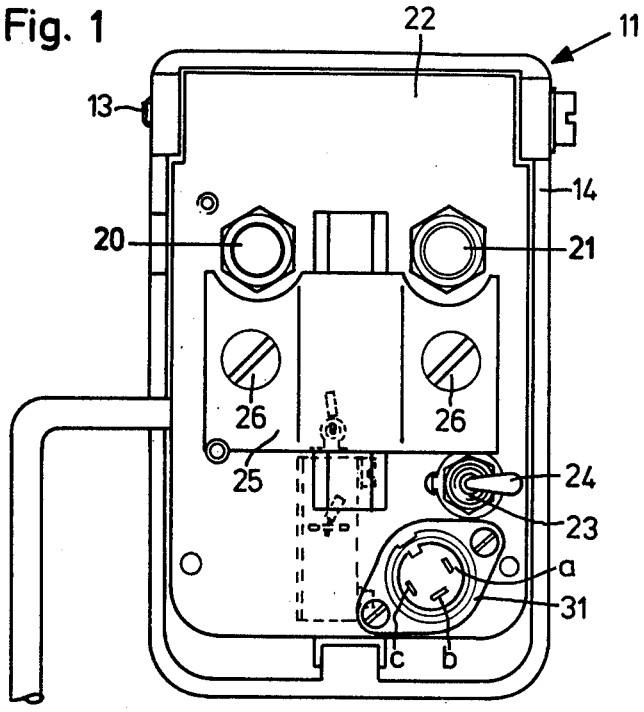
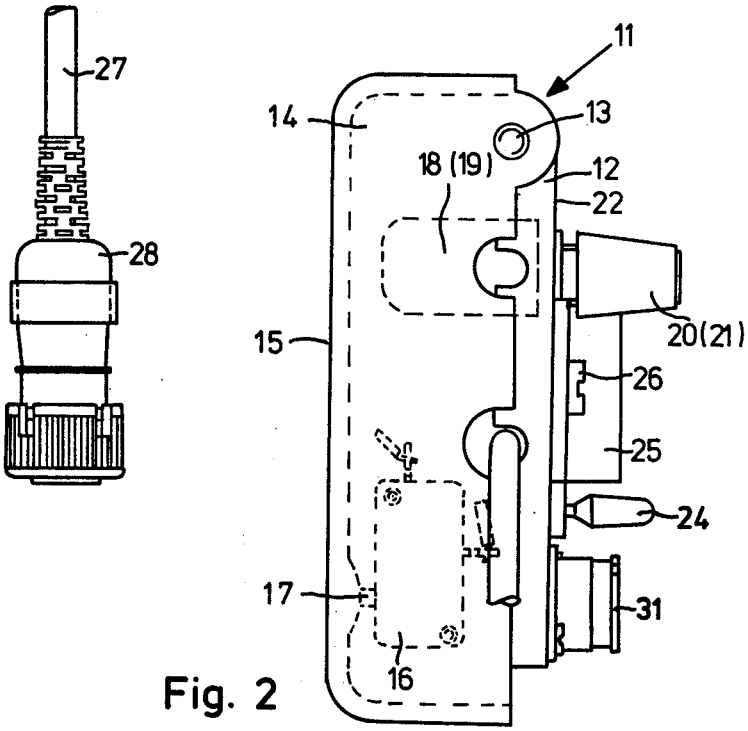
Fig. 2

APPARATUS FOR LIMITING MAXIMUM NUMBER OF STITCHES OF SEWING-MACHINES

BACKGROUND OF THE INVENTION

This invention relates to an apparatus for limiting the maximum number of stitches of sewing machines driveable by electrical regulating and control drives. The drive consists of a motor, a clutch and brake part associated with the motor, and a control part for the clutch and brake. At least one potentiometer and at least one switch are connected ahead of or beyond the latter to limit the maximum rotational speed of the drive.

Electrical regulating and control drives of this type for sewing machines are known from the journal *Bekleidung und Wäsche,* No. 7, 1970, pp. 466 to 470. Here, the motor rotates continuously, while the sewing machine is connected to the motor alternately or simultaneously using the clutch and brake. The clutch and brake are actuated by the control part, for example as a function of the needle position, in order to ensure that the sewing machine stops in a preset, for example an upper, dead-point position of the needle. In addition, such a control part can also serve for actuating a thread cutter, thread layer, a device to reduce thread tension, and the like. The control part is conventional and can be constructed as shown in the U.S. Pat. No. 3,407,910 granted Oct. 29, 1968 to Heidt.

Industrial sewing machines equipped with such drives operate at up to 6000 stiches per minute. For example, when sewing curves or when sewing fancy seams with particularly long stitches, the sewing machine cannot be driven at the rate which produces the maximum number of stitches, because the thread would break in the case of especially long stitches or the seamstress could no longer guide the material rapidly enough along the predetermined curve when sewing on curves. In order to provide assistance in this situation, it is already known to limit the maximum number of stiches of a sewing machine by limiting the maximum rotational speed of the drive, providing the control part with a potentiometer associated therewith, the potentiometer having a switch connected ahead of or beyond it, the switch being in the form of a position switch, i.e., a toggle or rotary switch.

SUMMARY OF THE INVENTION

The principal object of the the invention is to provide an apparatus of the type described hereinabove which is an independent easily operable unit.

The foregoing object, as well as others which are to become apparent from the test below, is achieved according to the invention by providing in the apparatus of the type described and independent knee switch, one of whose surfaces, swivelable about an axis, rests against the actuating element of a contact switch and whose other surface or surfaces is/are provided with a position switch and the actuating members of the two potentiometers. This spatial arrangement of the contact switch, position switch, and actuating members of the two potentiometers ensures especially simple operation. The knee switch is mounted on the sewing machine in a position which is anatomically suited to the seamstress. By means of the knee switch, she can quickly limit the maximum number of stitches without stopping sewing, in order for example to sew a continuous seam, with the maximum number of stitches along a straight stretch, then around a corner at reduced speed, and then another straight stretch at the maximum speed. If she wants to work longer at a reduced maximum number of stitches, she actuates the position switch, which is also in the vicinity of her knee. Hence, she need not look for the position switch on the machine, but, since it is located at the level of her knee, and is close to her body, she can reach for and operate the switch without looking. The same applies to the adjustment of the potentiometers to set the limited maximum number of stitches.

Optimum operating comfort is provided if the actuating elements of the two potentiometers and the position switch are mounted on the surface opposite the swivelable surface.

BRIEF DESCRIPTION OF THE DRAWINGS

Further advantages and features of the invention will be apparent from the description of an embodiment with reference to the drawing.

FIG. 1 is a knee switch according to the invention, shown in a top view;

FIG. 2 is a knee switch according to the invention, in a side view;

Detailed Description of the Preferred Embodiment

Figure 4:
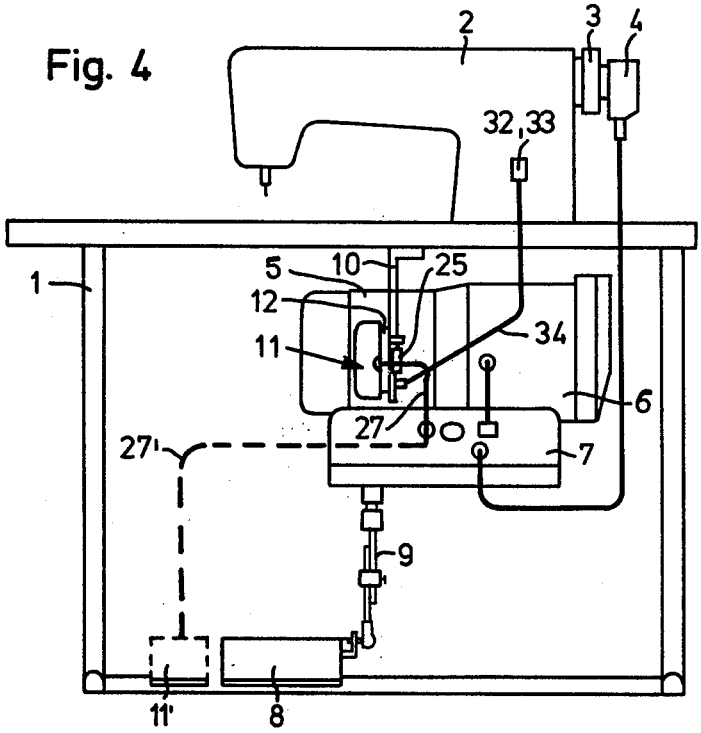
FIG. 4 is a sewing machine with a knee switch according to the invention.

Referring initially fo FIG. 4, a sewing machine 2 is mounted on a sewing machine table 1, with a position indicator 4 mounted on handwheel 3 of the sewing machine 2. The sewing machine 2 is driven by an electrical control and regulating drive mounted below sewing machine table 1, the drive consisting of a constantly rotating motor 5, a clutch and brake part 6 associated with the motor 5, and a control means mounted in a control box 7. The control box 7 is mounted on the housing of the motor 5. The drive is actuated by a pedal 8, connected by a rod 9 to switch contacts located in the control box 7. The design and operation of the entire drive as thus far described, is known from the journal *Bekleidung und Wäsche,* No. 7, 1970, pp. 466 to 470. The circuitry within the control box 7 can be as shown, for example, in FIG. 1 of the Patent to Heidt, supra.

A knee switch 11 is height-adjustably mounted on an arm 10, fastened to the underside of the sewing machine table 1 and extending downward. The knee switch as best seen in FIGS. 1 and 2, includes a base plate 12 and a cover-like part 14 articulated to the base plate and swivelable about an upper horizontal axis 13, a vertical surface 15 of the part 14, located vertical and approximately parallel to the base plate 12, serving as the surface to which the knee of the seamstress is to be applied. A contact switch 16 is located within the knee switch 11, on an inner surface of the base plate 12 facing the cover-like part 14. An actuating element (button) 17 of the contact switch 16 rests against the inside of the cover-like part 14, so that the contact switch 16 is actuated when the knee of the seamstress swivels outward. The switch 11 in use is connected in series with the circuitry of the control box 7 and the power supply. For example, the knee switch 11 may be connected in series between the power supply and the control circuitry shown in FIG. 1 of the patent to Heidt, supra.

Two potentiometers 18, 19 are mounted on the base plate 12, actuating members 20, 21 of these potentiometers being mounted on outer surface 22 of the base plate 12. A position switch 23, made in the form of a toggle switch, is likewise mounted on the base plate 12, a handle 24 of the switch 23 being located on the outer surface 22 of the base plate 12. A clamp 25 is likewise attached to the outer surface 22 of base plate 12 by bolts 26, by virtue of which the attachment and height adjustment, if desired, of the knee switch 11 on the arm 10 is provided.

The knee switch 11 is connectable by a cable 27 to the control box 7 by a plug 28.

It is apparent from FIG. 4 that the knee switch 11 can be designed to be used alternatively as a foot switch 11' which can be operated by the seamstress with her other foot without significant structural modifications, and can be so disposed that it can be connected by a cable 27' to the control box 7.

Figure 3:
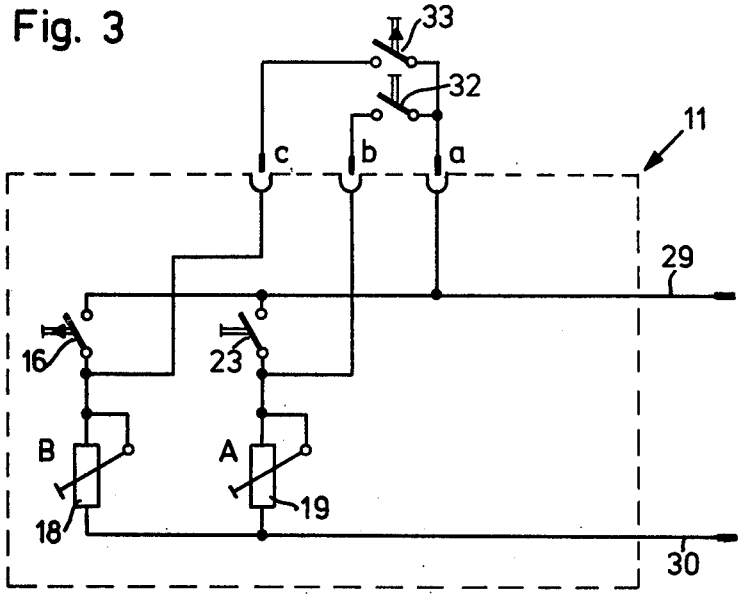
FIG. 3 is a circuit diagram of the knee switch, for purposes of clarification.

As is apparent from FIG. 3, the contact switch 16 and the potentiometer 18 are connected in series, on the one hand, and the position switch 23 and the potentiometer 19 are connected in series, on the other. These series connected circuits are connected in parallel across wires 29, 30 forming the cable 27. The base plate 12 is provided with a socket 31 with three inputs a, b, c, to which external switches 32, 33 can be connected by a cable 34, so that the function of contact switch 16 and/or position switch 23 can be assumed by other switches, mounted for example on the sewing machine 2 proper.

We claim:

1. In an apparatus for limiting the maximum number of stiches of sewing machines having a motor, a clutch and brake part associated with the motor, control means for the clutch and brake, and regulating circuit means including a first and a second potentiometer and switch means in circuit to limit the maximum rotational speed of the drive, the improvement wherein said switch means includes a contact switch, a position switch and an independent knee switch having a first surface and a second surface, said first surface being swivelable about an axis; an actuating member connected to said contact switch, said actuating member being in contact with said first surface and said position switch being mounted on said second surface; and adjusting members coupled to respective ones of said two potentiometers for allowing adjustment thereof, said adjusting members being positioned on a surface of said knee switch.

2. An apparatus according to claim 1, wherein said adjusting members of said first and second potentiometers are mounted on a surface which is opposite said first surface.

3. An apparatus according to claim 2 including a socket located on said surface which is opposite said first surface.

4. An apparatus according to claim 3, wherein said second surface is opposite said first surface.

5. An apparatus according to claim 2, wherein said second surface is opposite said first surface.

6. An apparatus according to claim 1, wherein said second surface is opposite said first surface.

7. Apparatus according to claim 1, including a socket located on said second surface.

8. An apparatus according to claim 7, wherein said second surface is opposite said first surface.

* * * * *